United States Patent [19]

Retzlaff

[11] Patent Number: 4,461,474

[45] Date of Patent: Jul. 24, 1984

[54] ARM WRESTLING EXERCISER

[76] Inventor: Albert R. Retzlaff, 1006 Terrace Dr., Napa, Calif. 94558

[21] Appl. No.: 495,044

[22] Filed: May 16, 1983

[51] Int. Cl.[3] ..... A63B 21/04

[52] U.S. Cl. ..... 272/139; 272/901; 272/142; 272/136

[58] Field of Search ..... 272/67, 120, 134–144, 272/900, DIG. 7, 93, 901

[56] References Cited

U.S. PATENT DOCUMENTS

| | | | |
|---|---|---|---|
| D. 256,822 | 9/1980 | Ozzimo | 272/901 X |
| 1,815,862 | 7/1931 | Noe | 272/142 |
| 3,345,067 | 10/1967 | Smith | 272/134 |
| 3,441,271 | 4/1969 | Palacios | 272/33 R |
| 3,559,487 | 2/1971 | Parlato | 272/67 X |
| 3,633,907 | 1/1972 | Cane | 272/135 X |
| 3,815,904 | 6/1974 | Weiss et al. | 272/136 |
| 4,093,212 | 6/1978 | Jacques | 272/DIG. 4 |

*Primary Examiner*—Richard J. Apley
*Assistant Examiner*—Chris Coppens
*Attorney, Agent, or Firm*—Melvin R. Stidham

[57] ABSTRACT

An arm wrestling exerciser including an angled anchor post of lumber with holes drilled at different levels to receive a cylindrical enlargement on one end of a wide elastic band. The selection of a particular hole to receive the end determines the amount of tension in the length of band extending from the anchor post.

5 Claims, 1 Drawing Figure

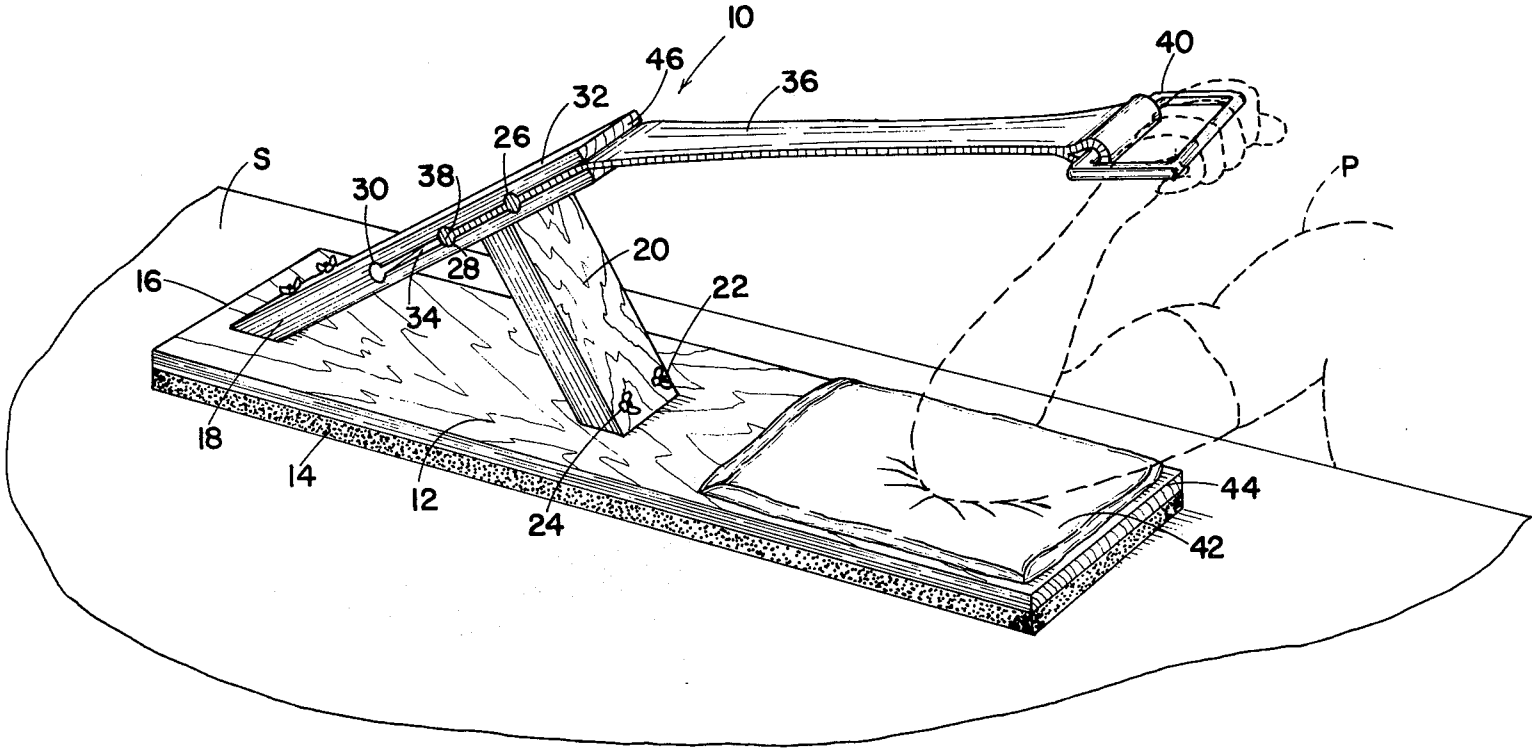
P
40
44
42
36
10
22
46
20
32
24
26
28
38
34
12
30
14
S
18
16

ARM WRESTLING EXERCISER

BACKGROUND OF THE INVENTION

Numerous arm exercisers have been developed that simulate the exercise encountered in competitive arm wrestling. However, most are incapable of adjustment to accommodate differing arm strengths of the users, or the developing arm strength of the consistent user. Many are bulky, or are not easily disassembled for transportation. Others require mechanical means for stabilization before they can be used.

OBJECTS OF THE INVENTION

It is an object of this invention to provide an arm wrestling exerciser that can be adjusted for tension and resistance.

It is a further object of this invention to provide an arm wrestling exerciser that is rugged in construction but readily collapsible for storage.

It is a further object of this invention to provide an arm wrestling exerciser that does not require use of a mechanical stabilizing means.

It is a further object of this invention to provide an arm exerciser that is light in weight and extremely portable.

Other objects and advantages of this invention will become apparent from the description to follow, particularly when read in conjunction with the accompanying drawing.

SUMMARY OF THE INVENTION

This invention comprises a simple, unique and efficient configuration for an arm exercising device for the development of arms, wrists and shoulders, and in particular, a device that simulates the exercise received in the sport of arm wrestling. The resistance providing elastic band is adjustably mounted to enable the user to increase or decrease the work required in exercising. The device is assembled utilizing quick release fasteners, such as wing nuts, for ease in disassembly and transportation. Further, by incorporating a high friction base, no mechanical securing is required before the device can be used.

BRIEF DESCRIPTION OF THE DRAWING

FIG. 1 is a view in perspective of an arm wrestling exerciser embodying features of this invention.

DESCRIPTION OF A PREFERRED EMBODIMENT

Referring now to the drawing with greater particularity, the arm wrestling exerciser of this invention 10 includes a flat base 12, which may constitute simply a suitable length, say 32 inches, of a ¾ inch by 10 inch board. The undersurface of the base 12 is preferrably covered with a pad of material 14, such as a foamed elastomer, which has a relatively high coefficient of friction but which is not abrasive. As so covered, the device 10 may be used on any surface S such as a table top without damage thereto and without sliding or slipping.

Angled upward from near one end 16 of the base 12 is an anchor post 18 and angled toward it to form a sort of A-frame is a support post 20. Both the anchor post 18 and support post 20 may be formed of standard 2×4 lumber, and are releasably secured to the base 12 as by means of bolts 22 and wing nuts 24. The support post 20 merely abuts, or nearly abuts, the anchor post 18 to resist any bending moment, but there are no screws, nails or other means attaching the two together. Hence, the wing nuts can be very quickly removed and the entire device 10 disassembled into a relatively flat package for storing. Constructed as described, the entire device 10 weighs less than seven pounds and is extremely easy to handle.

A series of holes 26, 28 and 30 are drilled through, the anchor post 18 parallel to the sides 32, and a long slot 34 is cut into the anchor post 18 to interconnect the bores 26, 28 and 30. This allows one to adjust tension from either side of the anchor post 18. Alternately, separate slots may be cut from the upper side 32 to open into each bore 26, 28 and 30.

The exercising tension member comprises a band of rubber or suitable elastomer 36 which has an integral cylindrical enlargement 38 at one end thereof of a diameter to be received snugly in any one of the holes 26, 28 or 30 the user P may select. Such holes, together with the slot 34, form the unique lock that holds the end 38 of the tension band 36 in place. The other end of the band 36 is provided with any suitable gripping means such as a handle 40 by means of which a person P can grip it with his elbow placed on a pad 42, which is secured to the base 12 adjacent the end 44 opposite that 16 to which the anchor post is secured.

To select the amount of tension desired, the user P merely selects one of the bores 26, 28 or 30 and slides the band through the slot 34 with the cylindrical enlargement 38 properly placed. The band extends then up through the slot 34 to the upper end 46 of the anchor post 18 to effectively foreshorten the band 36 so that most of the stretching occurs in the length between the upper end 46 of the anchor post 18 and the handle 40. In this way, the user P can select the amount of resistance he wishes to work against.

With the resilient friction pad 14 on the bottom of the base 16 the base is well anchored, particularly with the pressure applied, both through the support post 20 and by the elbow of the user P, requiring no clamps or other means to secure the base in place.

As an additional feature, the base 12 as described is sufficiently long so that the pad 42 may be used by two people facing each other in an actual wrist wrestling match.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. An arm wrestling exerciser including:

a relatively flat base board;

an upright stationary anchor post of standard lumber secured at its lower end to said base board near one end thereof and being inclined toward the other end thereof;

a support brace inclined toward said anchor post but not secured thereto to form an A-frame therewith and resist downward loads therefrom;

releasable means securing said anchor post and said support brace to said base member;

an elongated band of elastomeric material forming a stretchable tension member; and complementary means on said anchor post and one end of said tension member for releasably securing said one end to said anchor post at a selected one of at least two elevations to extend over an edge of said anchor post at the upper end thereof and toward the other end of said base member;

said complementary means comprising;

an enlargement on one end of said tension member;

at least two horizontal bores through said anchor post at different elevations to receive said enlargement selectively; and slots opening into said bores through which said band may extend.

2. The exerciser defined by claim 1 wherein:

said bores extend parallel to and intermediate to opposite faces of said anchor post;

and including means bifurcating the upper end of said anchor post to form said slots so that enlargement may be inserted selectively into one of said bores from a side of said anchor post with said elastic band extending upward through said bifurcation to extend out the upper end of said board.

3. The exerciser defined by claim 1 including a handle means attached to the other end of said elastic band.

4. The exerciser defined by claim 1 including:

a flat pad member of a high friction material attached to the underside of said base member.

5. The arm wrestling exerciser described in claim 1 including:

generally flat cushion means attached to the upper surface of said base member near the other end thereof for an elbow support.

* * * * *